US010456758B2

(12) United States Patent
Seiler et al.

(10) Patent No.: US 10,456,758 B2
(45) Date of Patent: Oct. 29, 2019

(54) MIXING SHAFT

(71) Applicant: Maschinenfabrik Gustav Eirich GmbH & Co. KG, Hardheim (DE)

(72) Inventors: Andreas Seiler, Tauberbischofsheim (DE); Matthias Bechtold, Hardheim (DE); Martin Dorr, Walldurn (DE); Christian Luksche, Grossostheim (DE)

(73) Assignee: Maschinenfabrik Gustav Eirich GmbH & Co. KG, Hardheim (DE)

( * ) Notice: Subject to any disclaimer, the term of this patent is extended or adjusted under 35 U.S.C. 154(b) by 0 days.

(21) Appl. No.: 16/084,659

(22) PCT Filed: Apr. 3, 2017

(86) PCT No.: PCT/EP2017/057874

§ 371 (c)(1),
(2) Date: Sep. 13, 2018

(87) PCT Pub. No.: WO2017/174521

PCT Pub. Date: Oct. 12, 2017

(65) Prior Publication Data

US 2019/0076802 A1 Mar. 14, 2019

(30) Foreign Application Priority Data

Apr. 8, 2016 (DE) ..... 10 2016 106 536
Nov. 25, 2016 (DE) ..... 20 2016 106 597 U

(51) Int. Cl.
*B01F 7/00* (2006.01)

(52) U.S. Cl.
CPC ..... *B01F 7/001* (2013.01); *B01F 7/00125* (2013.01); *B01F 7/00141* (2013.01);
(Continued)

(58) Field of Classification Search
CPC .. B01F 7/001; B01F 7/00125; B01F 7/00141; B01F 7/00258; B01F 7/00633; B01F 7/00641; B01F 7/00691
See application file for complete search history.

(56) References Cited

U.S. PATENT DOCUMENTS 356,571 A 1/1887 Chambers
4,108,385 A 8/1978 Funk
(Continued)

FOREIGN PATENT DOCUMENTS

CN 1743060 A 3/2006
CN 206897205 U 1/2018
(Continued)

OTHER PUBLICATIONS

Rafael Real Cabrera, International Preliminary Report on Patentability, PCT/EP2017/057874, dated Oct. 11, 2018 (English translation).

(Continued)

*Primary Examiner* — Anshu Bhatia
(74) *Attorney, Agent, or Firm* — Paul & Paul

(57) ABSTRACT

The present invention concerns a mixing shaft comprising a tool holder and a mixing blade, wherein the tool holder has a recess in which a portion of the mixing blade is fixed. To provide a simple mixing shaft, there is proposed a clamping portion fitted into the recess for fixing the mixing blade portion in the recess, wherein the clamping portion, the recess and the mixing blade portion are of such a configuration that a force-locking connection of the mixing blade in the recess is implemented by means of the clamping portion.

18 Claims, 15 Drawing Sheets

Figure 1:
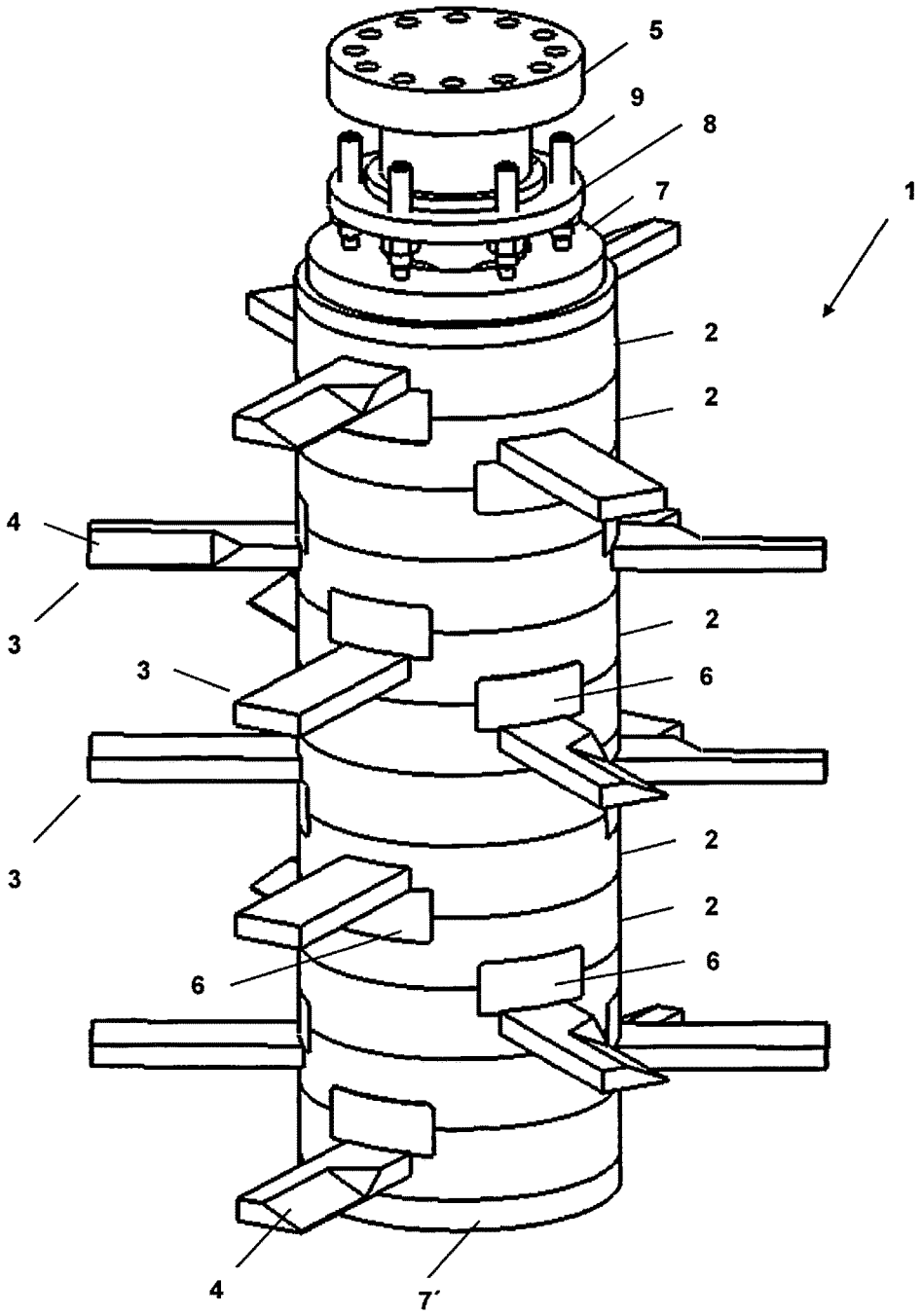

(52) U.S. Cl.
CPC ..... *B01F 7/00258* (2013.01); *B01F 7/00633* (2013.01); *B01F 7/00641* (2013.01); *B01F 7/00691* (2013.01)

(56) References Cited

U.S. PATENT DOCUMENTS

| | | | | |
|---|---|---|---|---|
| 5,061,082 | A | 10/1991 | Steele, Jr. | |
| 5,607,235 | A | 3/1997 | Campbell | |
| 6,435,832 | B1 | 8/2002 | Fasano | |
| 7,862,301 | B2 * | 1/2011 | Wu ..... | A01K 63/042 416/198 R |
| 2007/0076523 | A1 | 4/2007 | Yerian | |
| 2013/0003495 | A1 | 1/2013 | Pyddoke | |
| 2014/0252142 | A1 | 9/2014 | Rice | |
| 2019/0076802 | A1 | 3/2019 | Seiler et al. | |

FOREIGN PATENT DOCUMENTS

| | | | |
|---|---|---|---|
| DE | 29510143 | U1 | 9/1995 |
| DE | 102012105538 | A1 | 1/2014 |
| EP | 0976442 | A2 | 2/2000 |
| EP | 1595671 | A1 | 11/2005 |
| FR | 2317011 | A1 | 2/1977 |
| WO | 0183096 | A1 | 11/2001 |
| WO | 2006008079 | A1 | 1/2006 |
| WO | 2011115552 | A1 | 9/2011 |
| WO | 2014000733 | A1 | 1/2014 |

OTHER PUBLICATIONS

Office Action, dated Feb. 18, 2019, Japanese Patent Application No. 2018-551843 (English Translation).
Office Action, dated Mar. 11, 2019, Chinese Application No. 2017800204151, (English Translation).

* cited by examiner

MIXING SHAFT

CROSS-REFERENCE TO RELATED APPLICATION

This application is a 371 national stage application of International Application PCT/EP2017/057874, filed Apr. 3, 2017, and claims the priority of German Applications No. 10 2016 106 536.6, filed on Apr. 4, 2016, and No. 20 2016 597.6, filed on Nov. 25, 2016.

The present invention concerns a mixing shaft comprising a tool holder and a mixing blade in which a portion of the mixing blade is fixed in a recess in the tool holder.

Mixers having one or more mixing shafts arranged perpendicularly to the bottom of the mixing container are known. The mixing shafts frequently have a plurality of mixing blades which are arranged in a plurality of planes and which extend radially outwardly from the longitudinal axis of the mixing shaft.

The mixing blades serving as the working tools are subject to wear and therefore have to be renewed at given intervals. It has been found that the wear does not progress at the same rate at the various mixing blades. Mixing blades which are covered by a layer of material to be mixed of greater height wear markedly faster than mixing blades which are arranged near the surface of the material to be mixed.

It is known for the mixing blades to be screwed directly to the mixing tool shaft. That admittedly has the advantage that each mixing blade can be fitted separately but there is the disadvantage that the fixing screws are exposed to wear and fouling by the material to be mixed so that frequently after a prolonged period of operation the mixing blades can no longer be easily removed from the tool holder.

There are therefore already advanced systems for fixing mixing blades to a tool holder, in which the mixing blades are clamped centrally using mechanical or even hydraulic clamping devices. A disadvantage with those devices however is that an increased amount of structural effort is involved due to the mechanical or hydraulic clamping device. In addition with those systems it is only possible for all mixing blades to be released at the same time, that is to say even those mixing blades which are not intended to be replaced have to be released.

Mixing tools and shafts are already known from the publication U.S. Pat. No. 5,061,082 A, DE 2951014341, WO 2011/115552 A1, US 2007/076523 A1, FR 2317011 A1, US 2014/252142 A1, EP 1 595 671 A1 and U.S. Pat. No. 356,571 A.

That object is attained by a mixing blade as set forth in claim 1.

That object is attained in that a clamping part fitted into the recess in the tool holder is used for fixing the mixing blade portion in the recess, wherein the clamping part, the recess and the mixing blade portion are of such a configuration that a force-locking connection of the mixing blade in the recess is implemented by means of the clamping part.

In other words associated with each mixing blade is its own clamping part which, in the situation where the mixing blade is to be replaced, is released to release the mixing blade portion from the tool holder.

In that case the recess has a first and a second recess portion, wherein the mixing blade portion is arranged in the first recess portion and the clamping portion is arranged at least partially in the second recess portion.

For example the clamping part can be completely accommodated in the second recess portion so that the first recess portion is provided for receiving the mixing blade portion and the second recess portion is provided for receiving the clamping part. It will be noted however that it is also possible for the mixing blade portion in turn to have a mixing blade portion recess into which a part of the clamping part is fitted so that the clamping part can also be in part arranged in the first recess portion.

The clamping part and the mixing blade portion are thus fitted into the recess in mutually juxtaposed relationship to provide for clamping of the mixing blade portion in the recess.

According to the invention the clamping portion is supported both at the mixing blade portion and also at a wall of the second recess portion, wherein both the clamping portion and also either the mixing blade portion or the wall of the second recess portion have mutually corresponding wedge surfaces.

The mutually corresponding wedge surfaces which act like a ramp provide that, by insertion of the clamping part, it is pressed against the mixing blade portion. For example the clamping part can be fixed to the tool holder by one, two or more screws. Then, by tightening the screws, the clamping part is pulled into the recess along the corresponding wedge surfaces whereby the mixing blade portion is braced within the recess.

In a particularly preferred embodiment the clamping part has a pushing-off thread by way of which the clamping part can be pushed out of the recess again by means of pushing-off screw. For example the pushing-off thread can be so arranged that a screw can be screwed into the pushing-off thread in such a way that the end of the screw, that is remote from the screw head, bears against a surface of the mixing shaft, for example a surface of the tool holder, so that the clamping part is pushed out of the recess by rotation of the screw.

The wedge angle, that is to say the angle that the wedge surfaces include relative to a plane perpendicular to the longitudinal axis of the mixing shaft can in principle be freely selected. In practice a value of greater than 7° has proven appropriate. A slight self-locking action is to be expected with that angle. If that is not wanted the wedge angle must be greater, for example up to about 15°.

According to the invention the second recess portion is arranged in the axial direction beside the first recess portion. That has the advantage that, due to the rotational forces to be expected during use of the mixing shaft, no additional force is exerted by the mixing blade on the clamping portion. In principle the second recess portion can be arranged in the axial direction both above and also below the first recess portion. In practice it has proven appropriate if the second recess portion is arranged in the axial direction above the first recess portion as then fitment of the mixing blade portion in the tool holder is easier to implement. In this respect the terms "above" and "below" relate to the intended working position of the mixing shaft. The term end of the mixing shaft which is arranged higher than the other end is used to denote the upper end. If therefore the second recess portion is arranged above the first recess portion this means that the second recess portion is arranged closer to the upper end of the mixing shaft, than the first recess portion.

In a preferred embodiment provided at the upper end of the mixing shaft are means for fixing the mixing shaft to a motor shaft or a drive shaft.

In a further preferred embodiment the tool holder comprises a plurality of tool holder disks which are connected to the tool shaft and a bracing device for bracing the tool holder disks in the axial direction. The mixing shaft therefore comprises the tool shaft, the tool holder disks, the bracing device for the tool holder disks, the clamping device for the mixing blades and the mixing blades.

The recess is then arranged in at least one tool holder disk. Such an embodiment has the advantage that the mixing shaft is of a modular structure and, depending on the respectively desired length of the mixing shaft, further tool holder disks can be easily fitted to the shaft. For example the shaft can be of a hexagonal cross-section while the tool holder disks can have a hexagonal through opening with which it can be pushed over the shaft. Such a configuration has the advantage that the tool holder disks are connected to the shaft in positively locking relationship so that, by turning the shaft, the tool holder disks are rotated about their axis.

It is possible for the recess, that is to say the first recess portion and the second recess portion, to be arranged in the same tool holder disk.

In a preferred embodiment a first part of the recess is arranged in a first tool holder disk and a second part of the recess is arranged in a second tool holder disk, in which case then the tool holder disks are positioned in mutually juxtaposed relationship in such a way that the first and second parts of the recess form the recess. It is particularly preferred if each tool holder disk has both a first and also a second recess part which are respectively provided together with a second recess part and a first recess part respectively of an adjacently positioned further tool holder disk to form a recess.

Although therefore with this embodiment each tool holder disk has at least a first and also a second recess part, they do not together form a recess in the same tool holder disk. Instead, the recess is only formed together with a corresponding part of the recess in an adjacent tool holder disk.

The recess can also be composed of more than two recess parts in different tool holder disks so that the geometry of the recess can also be formed from more than two tool holder disks.

It is possible for the parts of the recess to be of such a configuration that the first part of the recess forms the first recess portion and the second part of the recess forms the second recess portion. That however does not have to be the case.

In a further preferred embodiment the clamping part is screwed to the tool shaft or preferably to the tool holder. If the clamping part is of a multi-part structure then in accordance with this embodiment at least a part of the clamping part should be screwed to the tool shaft or preferably to the tool holder.

In a further preferred embodiment there is provided a protective element which is arranged in the second recess portion and covers the clamping part. In that case the protective element best completely closes the second recess portion without a gap and more specifically preferably also in relation to the mixing blade. The protective element can be for example a protective cap which can be made for example from a plastic or another material which is easy to remove. In that case the recess should terminate as flush as possible with the outside contour of the tool holder so as to prevent the protective cap from accidentally coming loose from the recess portion in operation.

Alternatively the recess can also be closed with a setting injection or casting material like for example silicone.

In a further particularly preferred embodiment the mixing blade portion and the tool holder are connected together by way of a pin connection or another positively locking connection. For example the mixing blade portion can have a through opening, preferably of circular cross-section, and a pin can be arranged in the first recess portion, that is connected to the tool holder. Then, for fixing the mixing blade portion, the blade portion can be pushed with its through opening over the pin.

At high peripheral speeds of the mixing shaft the positively locking connection prevents the mixing blades coming out of the recess when there is a reduced force-locking action at the clamping connection due to the centrifugal forces occurring.

In a further preferred embodiment it is provided that the tool holder disk is substantially in the shape of a circular ring in a cross-section perpendicular to the axis of rotation, wherein the positively locking connection, for example the pin of a pin connection, is arranged closer to the inner radius of the circular ring shape than to the outer radius.

In a further preferred embodiment, for the situation where the mixing blade portion has an opening as part of the positively locking connection, it is provided that the clamping part at least partially covers that opening, the clamping part preferably completely covering the opening. In that way on the one hand the opening is additionally protected from dust and on the other hand the static friction between the clamping part and the mixing blade portion is reduced whereby assembly and dismantling of the mixing shaft is easier.

In addition a better clamping action is achieved by that arrangement. Therefore the clamping part in the inserted condition is preferably so arranged that in a projection on to a plane perpendicular to the axis of rotation it partially or at the best completely overlaps with the positively locking connection. In other words the clamping part, in an axial direction, is arranged above or below the positively locking connection.

In a further preferred embodiment it is provided that the clamping part in the peripheral direction is of a maximum extent greater than the maximum extent of the mixing blade portion.

Particularly in the case of applications which require a multiplicity of mixing blades which are only little spaced apart in the axial direction the smallest spacing between the mixing blade portion and the tool holder in the axial direction is less than the necessary displacement travel of the mixing blade portion in the axial direction for releasing the mixing blade from the positively locking connection.

For insertion or removal of the mixing blade into or from the tool holders the mixing blade can then be tilted with respect to a plane perpendicular to the axis of rotation. That tilting is possible by virtue of the corresponding wedge surfaces. The mixing blades cannot be released without tilting, that is to say only by axial relative movement with respect to the tool holder.

Figure 1A:
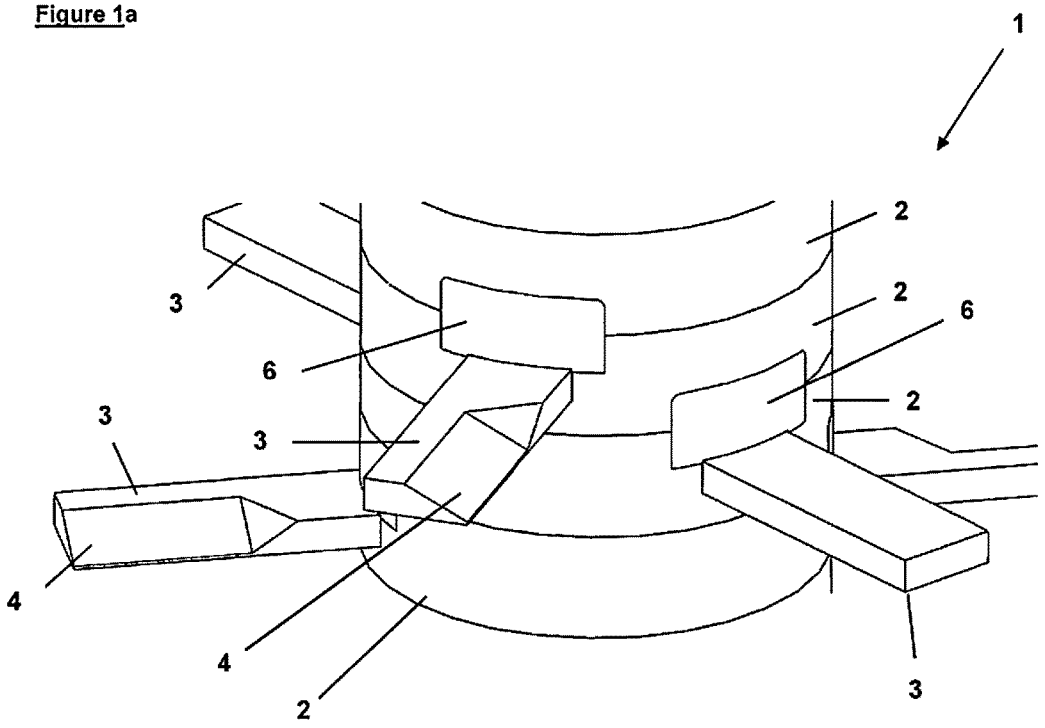
Figure 2:
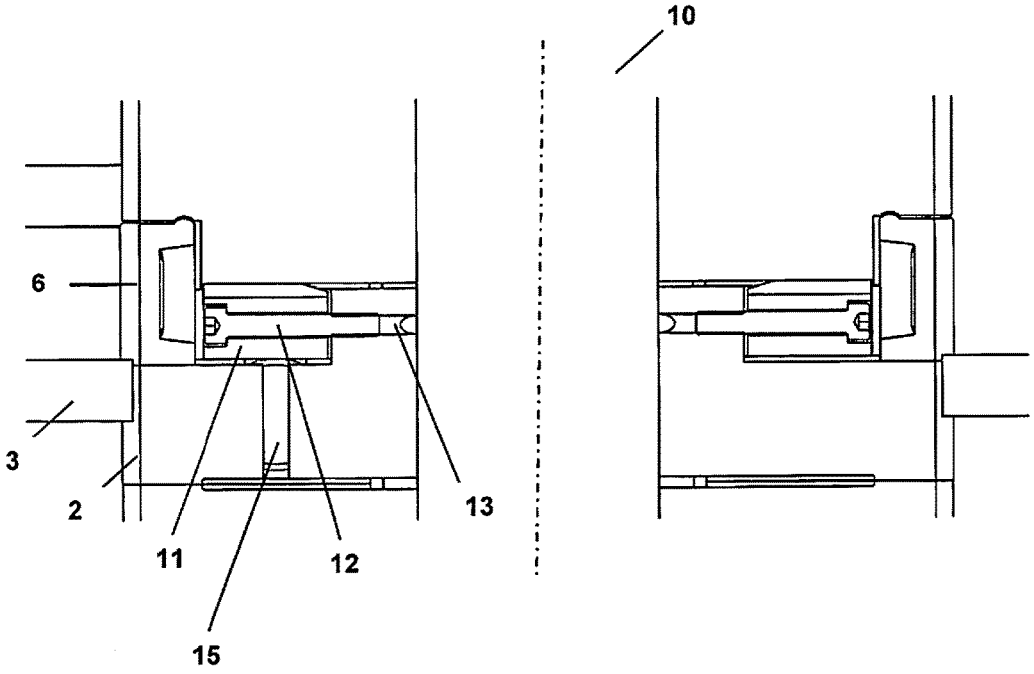
Figure 3:
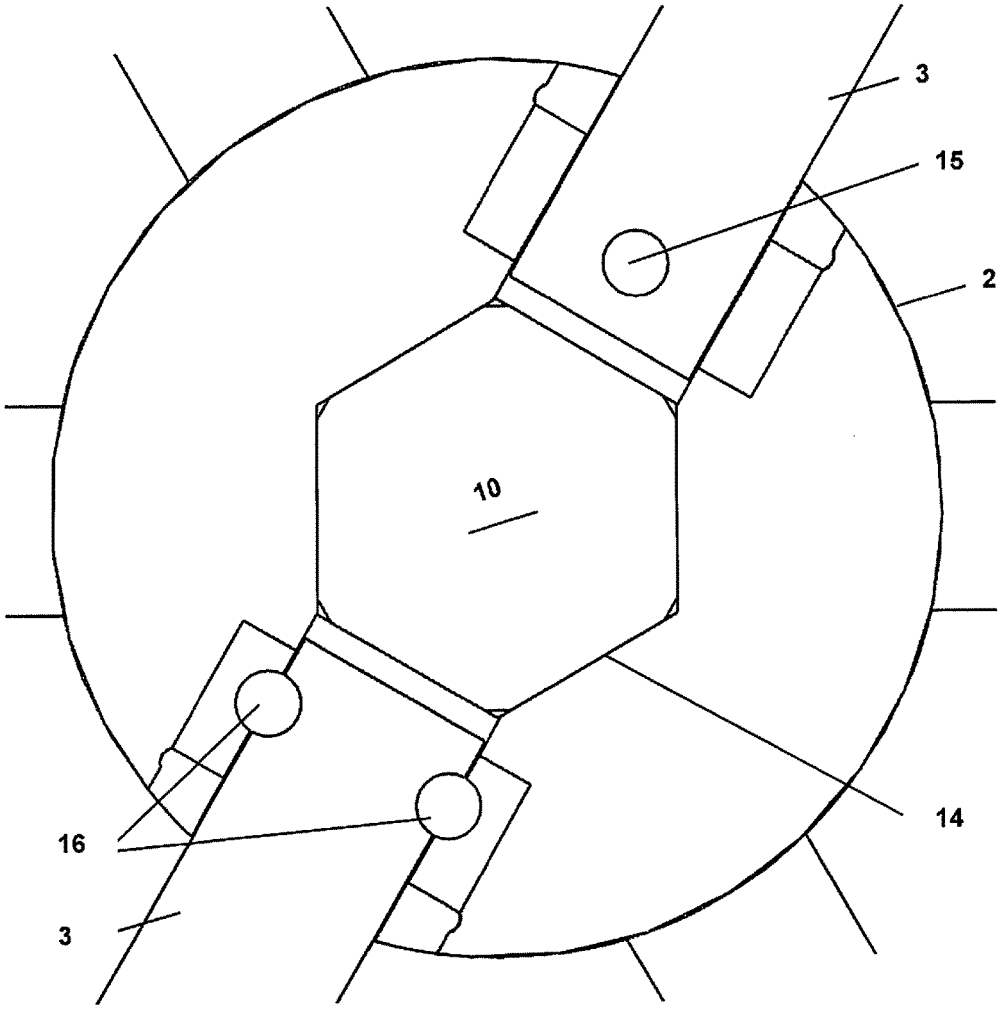
Figure 4:
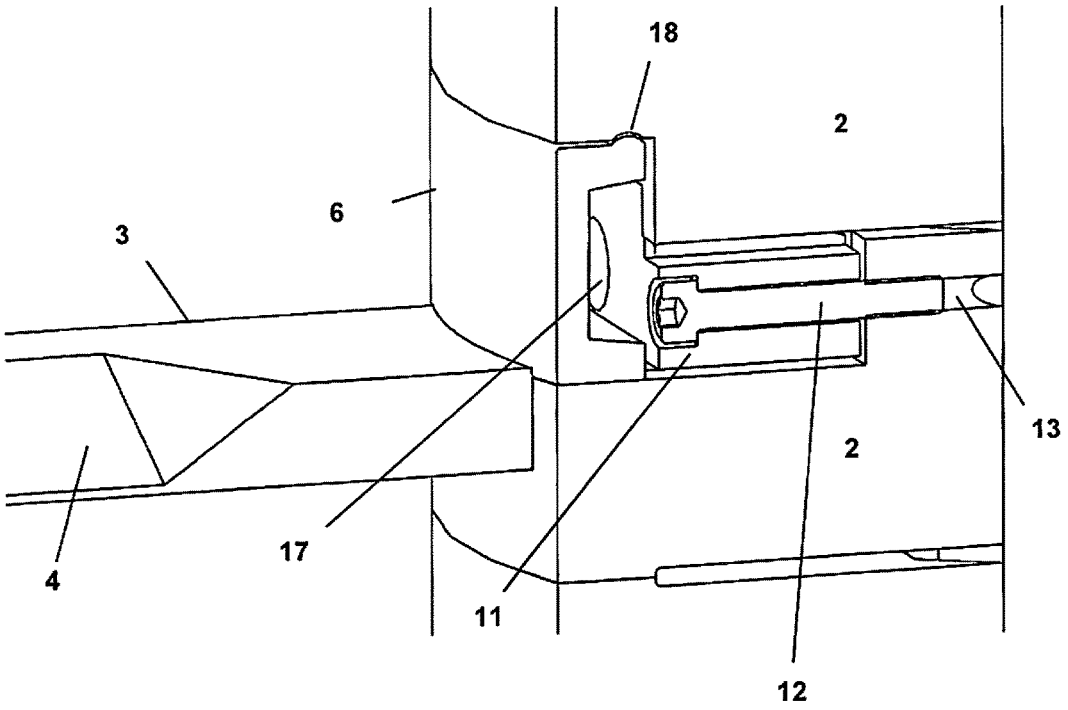
Figure 5:
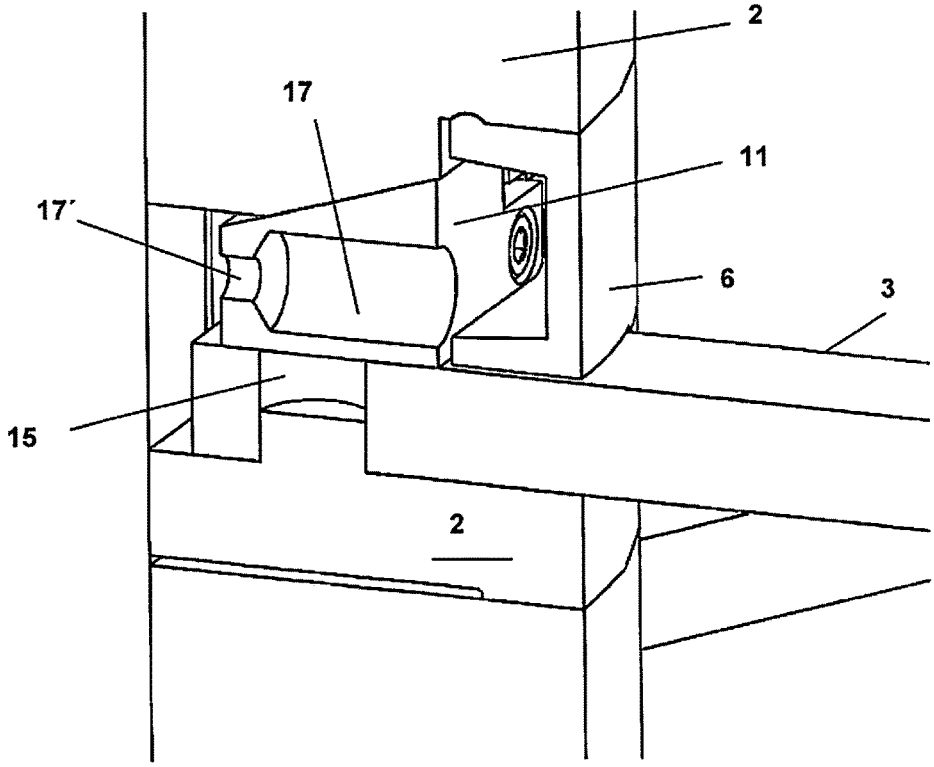
Figure 6:
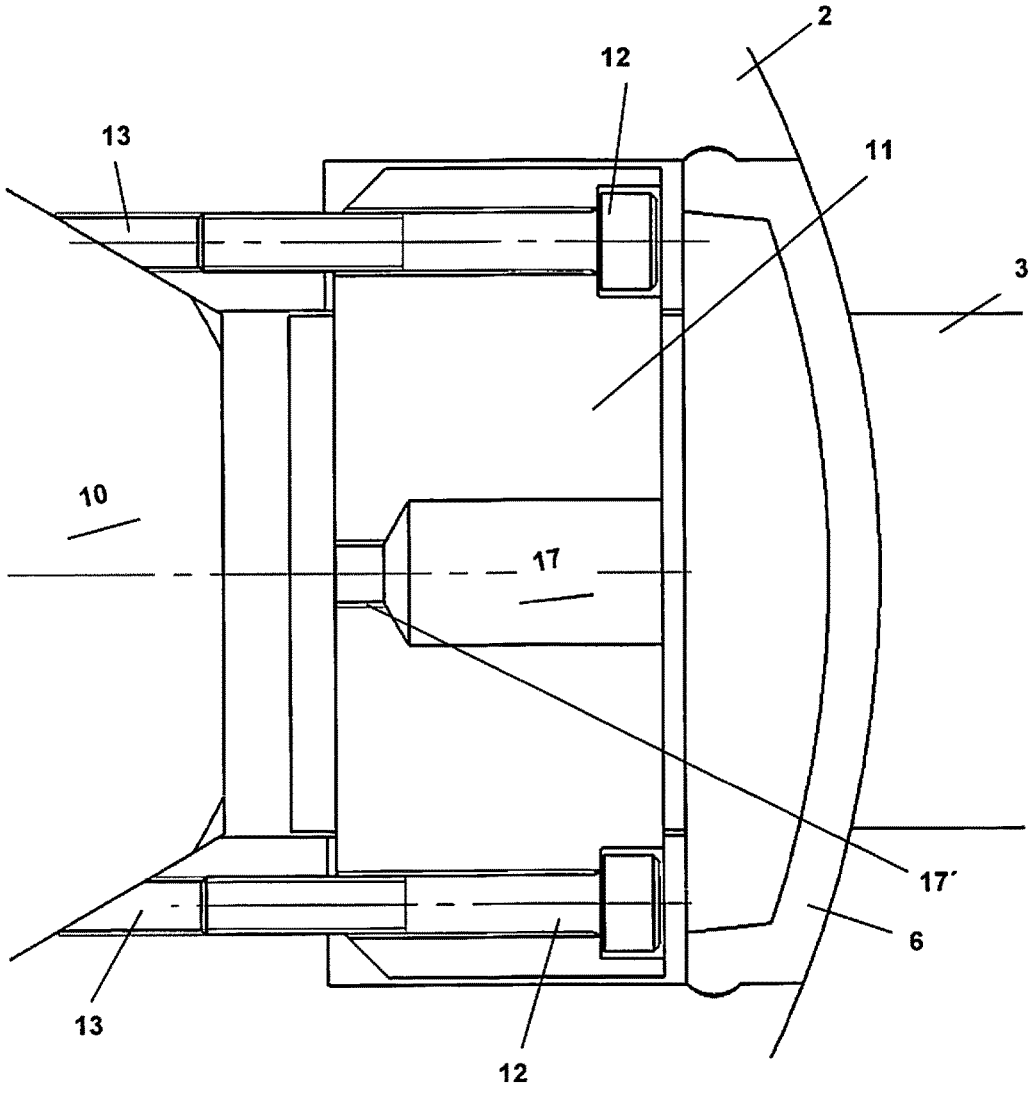
Figure 7:
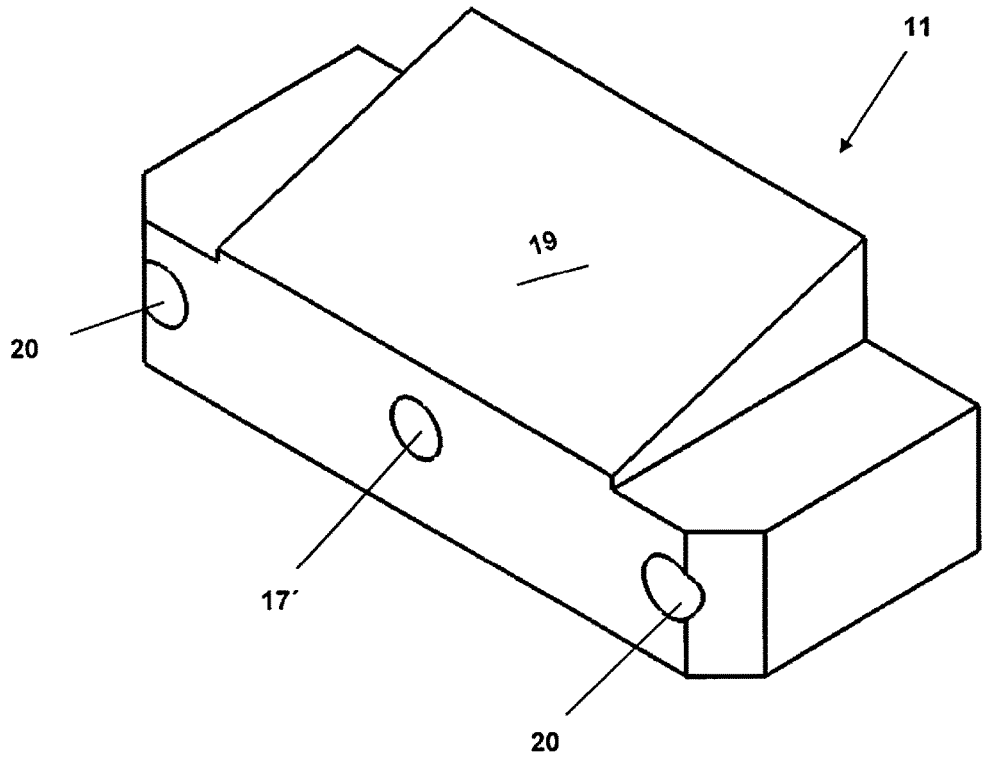
Figure 8:
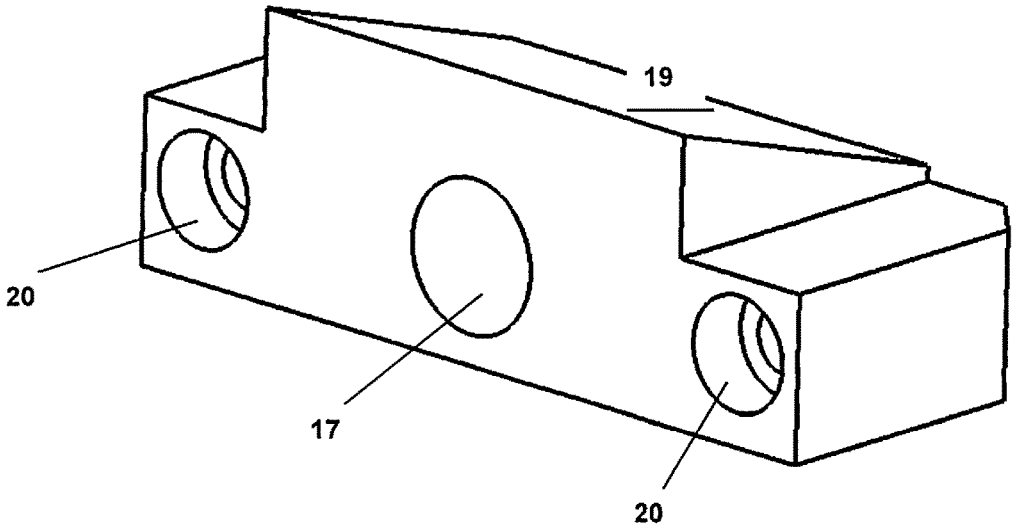
Figure 9:
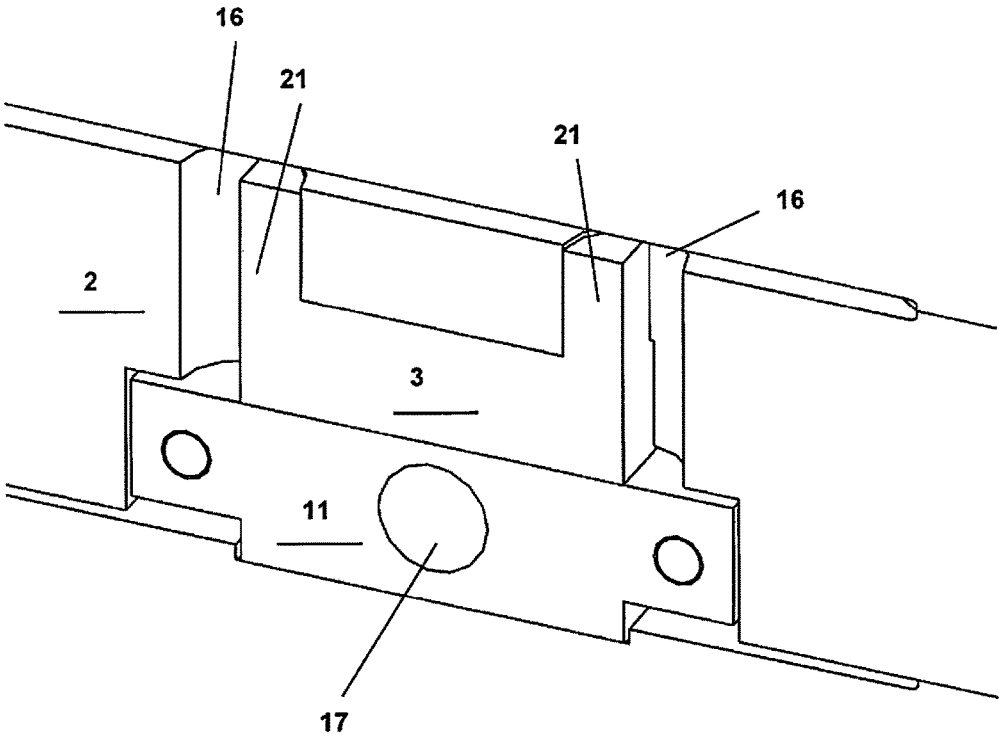
Figure 10:
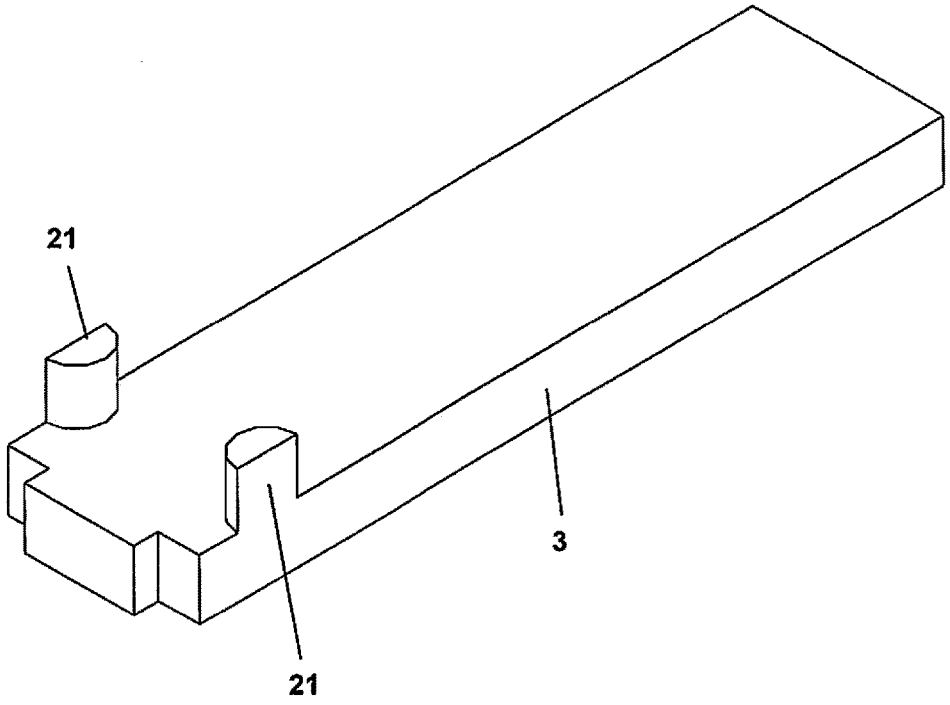
Figure 11:
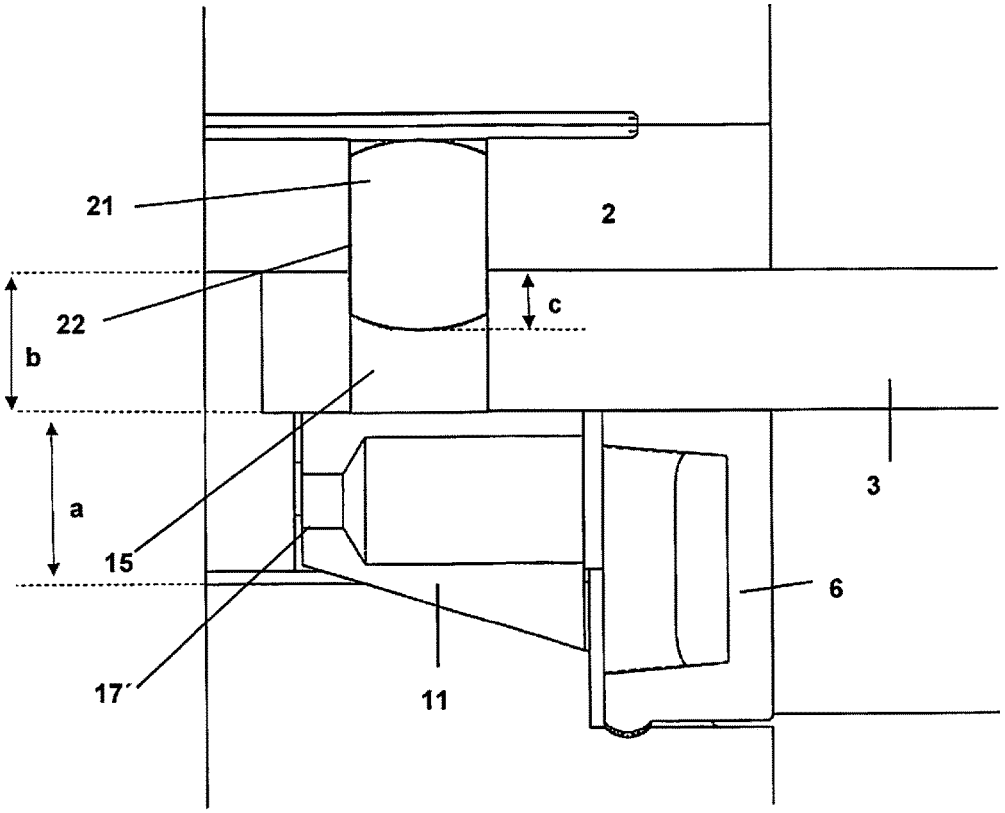
Figure 12:
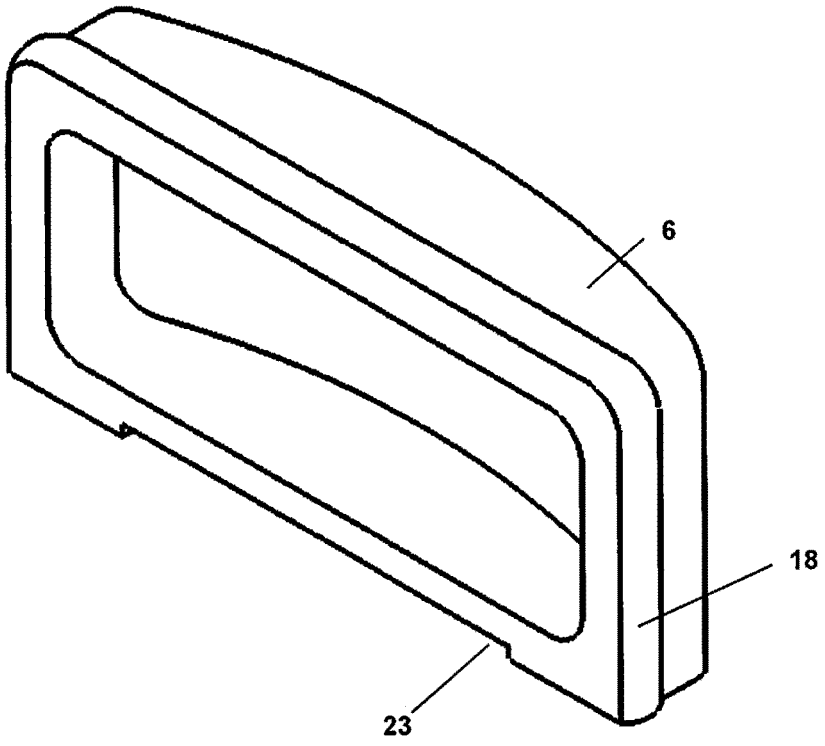
Figure 13:
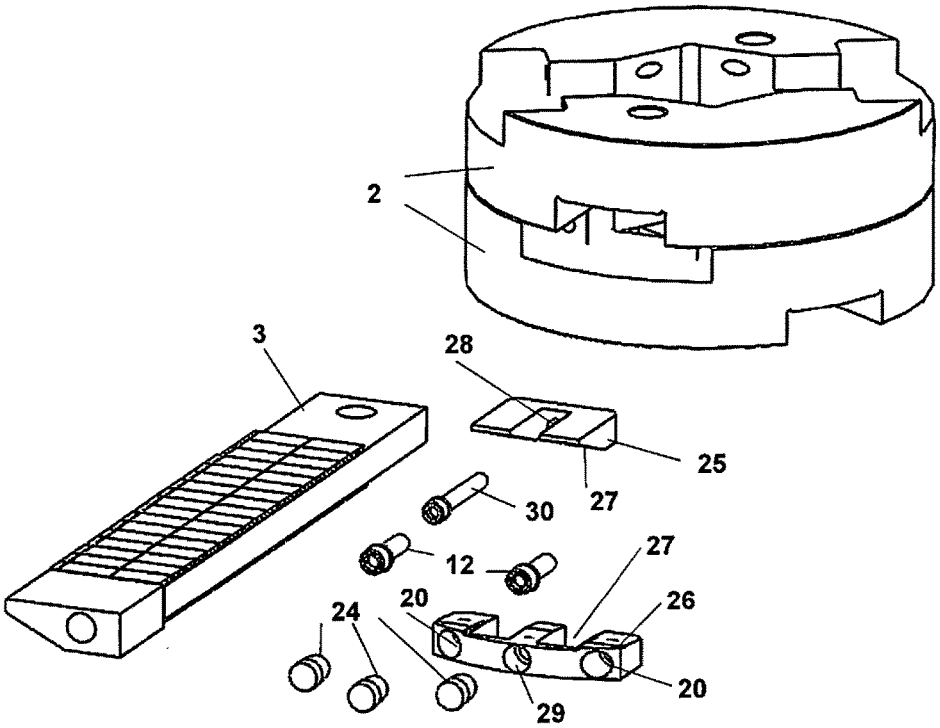
Figure 14:
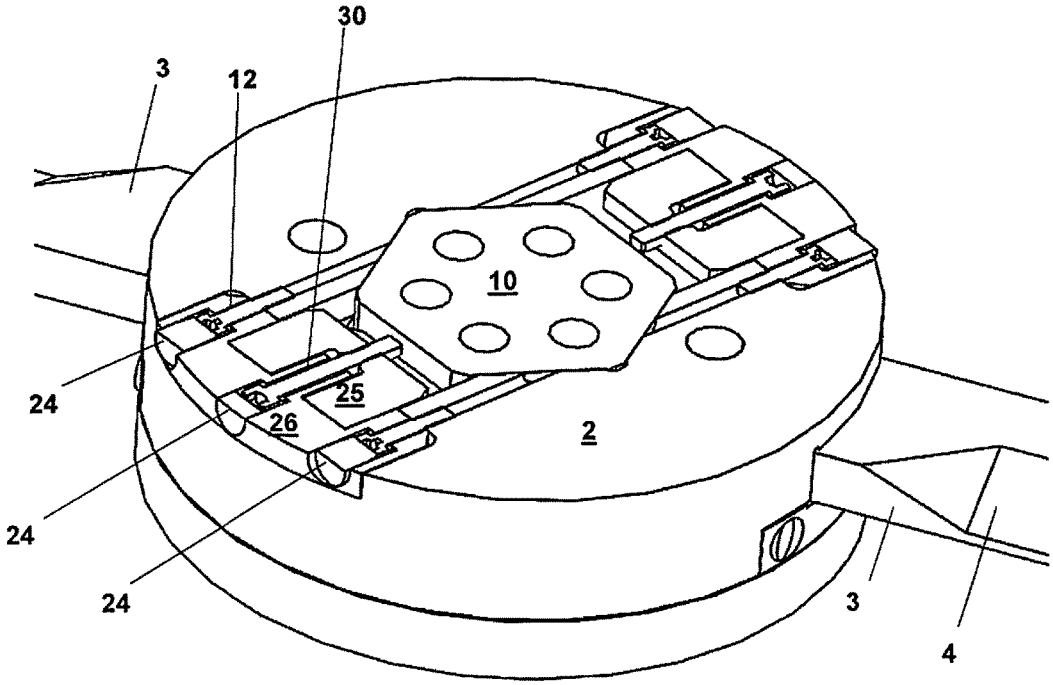

Further advantages, features and possible uses will be clearly apparent from the description hereinafter of a preferred embodiment and the accompanying Figures in which:

FIG. 1 shows a perspective view of a mixing shaft according to the invention, FIG. 1*a* shows a perspective partial view of the embodiment of FIG. 1, FIG. 2 shows a longitudinal section through an embodiment according to the invention of a mixing shaft, FIG. 3 shows a plan view of a tool holder disk of the embodiment of FIG. 1, FIG. 4 shows an isometric detail view of a mixing shaft according to the invention, FIG. 5 shows a further isometric detail view of a mixing shaft according to the invention, FIG. 6 shows a partial cross-sectional view of the embodiment of FIG. 1, FIG. 7 shows a perspective front view of a clamping part, FIG. 8 shows a perspective rear view of the clamping part of FIG. 7, FIG. 9 shows a longitudinal section through the shaft when using half-round dogs, FIG. 10 shows a perspective view of a mixing blade of the embodiment of FIG. 9, FIG. 11 shows a partial sectional view of a second embodiment, FIG. 12 shows a perspective view of a closure cap, FIG. 13 shows an exploded view of a third embodiment, and FIG. 14 shows a perspective sectional view of the third embodiment.

FIG. 1 shows a perspective view of a mixing shaft 1. The mixing shaft 1 has a tool holder which in this embodiment comprises a plurality of tool holder disks 2. The tool holder disks 2 together form a cylindrical body which in operation is rotated about its cylinder axis. A plurality of mixing blades 3 project beyond the outside surface of that cylinder. Those mixing blades 3 can have inclined edges 4 but that does not have to be the case. For that reason in the Figure some mixing blades 3 are shown with corresponding inclined edges while other mixing blades do not have such edges.

At its upper end the mixing shaft 1 has a fixing flange 5 with which it can be fixed to a corresponding drive shaft.

Protective caps 6 can be seen immediately above or below the mixing blades 3. The protective caps 6 can be fitted into corresponding recess portions in the tool holder disks 2 and terminate flush therewith. The protective caps 6 can be made for example from plastic.

FIG. 1*a* shows a perspective partial view of the FIG. 1 embodiment. Various mixing blade geometries are shown both in FIG. 1 and also in FIG. 1*a*. In general however only a single geometry is used in a mixing shaft. The Figures however are intended to clearly show that in principle different geometries can be used.

In addition the protective caps 6 are shown in part above and in part below the mixing blades 3. In general preferred embodiments are those in which the protective caps are arranged either all above the mixing blades or all below the mixing blades.

The individual tool holder disks 2 are arranged on a mixing shaft 10 (not shown in FIGS. 1 and 1*a*). To press the individual tool holder disks 2 against each other the arrangement has an upper annular termination disk 7, a bracing ring 8 and a plurality of bracing screws 9. A plate spring in the form of a circular ring (not shown) is installed beneath the termination disk 7 and the upper edge of the uppermost tool holder disk 2. The bracing screws 9 can be so fixed in corresponding threaded bores in the bracing ring 8 that they press the termination disk 7 on to the pack of tool holder disks 2 and brace same. In the braced condition the plate spring produces a counteracting force on the termination disk 7 in order reliably to prevent loosening of the bracing screws in operation. The tool holder disks are supported at the lower end of the tool shaft on a termination disk 7' which is in the shape of a circle or a circular ring and which is screwed to the shaft.

FIG. 2 shows a longitudinal section through the shaft 10 with a section through the elamping part 11. It is also possible to see here the tool holder disk 2 having a threaded bore 13. A clamping part 11 is screwed fast by means of the fixing screw 12 in the threaded bore 13 of the tool holder disk 2. The mixing blade 3 is braced within the tool holder by means of the clamping part 11. To avoid soiling of the fixing screw 12, in particular its screw head, during operation the recess in the tool holder disk is of such a configuration that the protective cap 6 can be fitted into the recess in such a way that it terminates substantially flush to avoid dirt getting into the recess.

FIG. 3 shows a plan view of a tool holder disk 2. The Figure clearly shows the hexagonal recess 14 serving to receive a correspondingly shaped tool shaft 10.

In the illustrated embodiment the tool holder disk 2 has two recesses, into respective ones of which a portion of a mixing blade 3 is fitted. In the illustrated embodiment a mixing blade 3 has a circular opening through which a pin 15 connected to the tool holder disk 2 is passed.

In contrast the portion of the other mixing blade 3 has two indentations at the left and right edges, into which two pins 16 which are both mounted to the tool holder disk engage. The fact that the Figure shows two different fixing systems, that is to say fixing with a pin 15 or fixing with two pins 16, only serves to illustrate that different fixing systems can be used to make a positively locking connection. In general an embodiment in which only one of the two fixing systems is used is to be preferred to reduce the stocking requirement of the corresponding mixing blades. It is only for the situation where mixing blades of different geometries are used within the mixing shaft that different fixing systems can be used to identify the mixing blade geometry, in order to ensure that the correct mixing blade geometry is always positioned in the correct recess. The pins, projections or recesses can also be formed with a part-circular, for example semicircular cross-section, or another cross-section.

FIG. 4 shows a further isometric detail view of a mixing shaft according to the invention.

It will be seen here that the recess in the tool holder extends over two tool holder disks 2. The part of the recess that is arranged in the lower tool holder disk 2 includes the first recess portion. A portion of the mixing blade 3 is positioned in that recess portion. The second recess portion is partly arranged in the part of the recess, that is provided by the upper tool holder disk 2. The clamping part 11 is thus partly arranged in the recess part provided by the lower tool holder disk and partly in the recess part provided by the upper tool holder disk 2. In the illustrated embodiment the protective cap 6 is of a U-shaped form, wherein arranged at the outside of a limb of the U-shape is a rib engaging into a corresponding groove 18 in the inside wall of the second recess portion. The protective cap 6 preferably made from plastic can then be clipped into the corresponding recess so that it engages into the groove 18. For removal purposes the protective cap can be pierced for example with a tool and levered out of the recess.

The recess is of a stepped configuration in the axial direction, that is to say the recess has a part of a smaller width in the peripheral direction and a part of a larger width in the peripheral direction. The width of the mixing blade portion approximately corresponds to the smaller width so that the mixing blade portion can be fitted into the part of smaller width. The height of the mixing blade portion in the axial direction is however somewhat greater than the height of the part of the smaller width so that the mixing blade portion projects somewhat into the part of greater width.

That arrangement ensures that the clamping part 11 is supported on the mixing blade portion and not on the top side of the lower tool holder disk in order in that way to permit a secure force-locking connection.

FIG. 5 shows a further isometric detail view of a mixing shaft according to the invention. In this embodiment the mixing blade 3 has a through opening 15, into which a pin engages. In the embodiment shown here the pin is in one piece with the tool holder disk 2.

In addition the section here through the clamping part 11 is so selected that it is possible to see a further bore 17 with an adjoining pushing-off thread 17'. That bore 17 with the pushing-off thread 17' is required only for dismantling of the clamping part 11. Firstly the screws 12 are released. In order to press the clamping part 11 out of its position a screw is screwed into the bore 17, the base of the screw then pressing for example against the tool shaft 10 to push the clamping part 11 radially outwardly.

That will be still more clearly apparent by referring to the cross-sectional view in FIG. 6 through the clamping part 11. It will be seen here that the clamping part 11 is held to the tool holder disk 2 by means of two fixing screws 12. The further bore 17/17' can be used for pressing the clamping part 11 off the tool holder disk 2.

FIGS. 7 and 8 show two perspective views of the clamping part 11. The clamping part 11 has an inclined wedge surface 19. By fitting the clamping part 11 to a tool holder disk 2, the clamping part 11 can be pressed radially inwardly by means of the fixing screws 12 which engage into the corresponding bores 20 so that the wedge surface 19 which bears against a corresponding wedge surface of the tool holder disk 2 braces the portion of the mixing blade in the tool holder.

FIG. 9 shows a longitudinal section through the shaft when using half-round dogs for fixing the mixing blade in the tool holder. A perspective view of the mixing blade 3 of this embodiment is shown in FIG. 10. In this embodiment the mixing blade 3 has two semicircular dogs 21 engaging into corresponding bores 16 in the tool holder disk 2. In the illustrated embodiment the dogs are joined in one piece to the mixing blade. In principle, instead of that the dogs could be fixed to the tool holder disk 2, in which case then the portion of the mixing blade 3 would have to have corresponding bores or recesses for receiving the dogs.

An alternative fixing option is shown in the isometric view in FIG. 11 as a second embodiment of the invention. On the one hand the wedge-shaped clamping part 11 is here arranged beneath the mixing blade 3. On the other hand a separate pin 21 is provided here, that engages both into a corresponding opening 15 in the mixing blade and also into a corresponding opening 22 in the tool holder disk 2. In that respect the length of the pin portion of the pin 21, that engages into the mixing blade 3, is less than the height of the mixing blade 3 in order to permit easier removal and a more compact configuration in respect of the tool holder disks. In this case the clamping part 11 completely covers the through opening 22 in the mixing blade 3. In this embodiment the smallest spacing a between the mixing blade portion 3 and the tool holder 2 in the axial direction is greater than the height b of the mixing blade portion 3 in the axial direction. Alternatively however it can also be less. It is even possible for the smallest spacing a between the mixing blade portion and the tool holder in the axial direction to be less than the necessary displacement travel c of the mixing blade portion in the axial direction to release the mixing blade from the positively locking connection.

FIG. 12 shows a perspective view of the inside of the protective cap 6. It will be seen that the cap 6 has a rib 18 extending around three sides, that engages into corresponding grooves 19 in the tool holder disk 2. In addition on the fourth edge it has a recess 23 in order in that way to permit closure which is as gap-free as possible relative to the mixing blade 3.

FIG. 13 shows an exploded perspective view of a third embodiment of the invention. As far as possible identical components are denoted by the same references.

By way of example two tool holder disks 2 are shown here, which together have a recess for receiving a mixing blade 3 and a clamping part 25, 26. The clamping part 25, 26 comprises a first part 25 and a second part 26. The two parts 25, 26 have mutually corresponding wedge surfaces 27. The two parts 25, 26 are placed upon each other in such a way that the corresponding wedge surfaces 27 bear against each other. The second part 26 of the wedge element has a bore 29 which here is in the form of a stepped bore. The first part of the clamping part 25 has a threaded bore 28. The second part 26 can be fixed to the first part 25 by means of a fixing screw 30. The first part 25 is drawn in the direction of the second part 26 by tightening of the screw 30 so that it is displaced on the wedge surfaces 27 and the two-part wedge element 25, 26 expands in the axial direction, thereby producing the clamping action.

As can be seen from a perspective sectional view in FIG. 14 the second part 26 of the clamping part is fixed to the tool holder disk 2 by means of the fixing screw 12. In this case the second part 26 of the clamping part is of such a configuration that it terminates substantially flush with the peripheral surface of the tool holder disks 2. If now the fixing screw 30 is tightened or loosened that results in a relative movement of the first part of the clamping part 25 in the radial direction by virtue of the force applied by the fixing screw 30 and in the axial direction by virtue of the wedge surfaces 27 being of a mutually corresponding configuration, whereby the wedge element becomes "thicker" and "thinner" respectively in the axial direction in order to clamp the mixing blade 3 in position within the recess in the tool holder disk 2 or to release it.

To prevent soiling of the heads of the screws 12, 30 during operation plugs are fitted into the stepped bores.

LIST OF REFERENCES

1 mixing shaft
2 tool holder disks
3 mixing blades
4 inclined edges
5 fixing flange
6 protective caps
7 termination disk
7' screwed termination disk
8 bracing ring
9 bracing screws
10 tool shaft
11 clamping part
12, 30 fixing screw
13, 28 threaded bore
14 hexagonal recess
15 pin
16 two pins
17, 29 bore
17' pushing-off thread
18 groove/rib
19 wedge surface/groove
20 bores
21 dogs/separate pin
22 corresponding opening
23 recess
24 plug
25 first part of a clamping part
26 second part of a clamping part
27 wedge surfaces

The invention claimed is:

1. A mixing shaft comprising a tool holder and a mixing blade (3), wherein the tool holder has a recess in which a portion of the mixing blade (3) is fixed, wherein there is provided a clamping part (11) fitted into the recess for fixing the mixing blade portion in the recess, wherein the clamping part (11), the recess and the mixing blade portion are of such a configuration that a force-locking connection of the mixing blade (3) in the recess is implemented by means of the clamping part, wherein the recess has a first and a second recess portion, wherein the mixing blade portion is arranged in the first recess portion and the clamping part (11) is arranged at least partially in the second recess portion, wherein the tool holder has an axis of rotation and the mixing shaft (1) is adapted to be rotated about the axis of rotation, wherein the second recess portion is arranged in the axial direction beside the first recess portion, characterised in that the clamping part (11) is supported both at the mixing blade portion and also at a wall of the second recess portion, wherein both the clamping part (11) and also either the mixing blade portion or the wall of the second recess portion have mutually corresponding wedge surfaces (13), or the clamping part (11) is of a two-part structure and the two parts of the clamping part (25, 26) have mutually corresponding wedge surfaces (27).

2. A mixing shaft as set forth in claim 1 characterised in that the first part of the clamping part (25) has a threaded bore and the second part of the clamping part (26) has a through bore which are so arranged that the second part of the clamping part (26) can be fixed to the first part of the clamping part (25) by means of a screw which engages through the through bore in the second clamping part (26) into the threaded bore in the first part of the clamping part, so that the corresponding wedge surfaces (27) of the clamping part (25, 26) bear against each other, and the two parts of the clamping part (25, 26) can be displaced relative to each other by rotation of the screw.

3. A mixing shaft as set forth in claim 1 characterised in that the tool holder comprises a tool shaft (10) and a plurality of tool holder disks (2) connected to the tool shaft (10), wherein the recess is arranged in at least one tool holder disk (2).

4. A mixing shaft as set forth in claim 3 characterised in that the recess comprises two recess parts, wherein the first recess part is arranged in a first tool holder disk (2) and the second recess part is arranged in a second tool holder disk (2), wherein the tool holder disks (2) are positioned in mutually juxtaposed relationship in such a way that the first and second recess parts form the recess.

5. A mixing shaft as set forth in claim 4 characterised in that each tool holder disk (2) has both a first and also a second recess part which are respectively provided together with a second recess part and a first recess part respectively of an adjacently positioned further tool holder disk (2) to form a recess.

6. A mixing shaft as set forth in claim 1 characterised in that the clamping part (11) is screwed to the tool shaft (10).

7. A mixing shaft as set forth in claim 6 characterised in that there is provided a protective element which is arranged in the second recess portion and covers the clamping portion part (11), wherein the protective element completely closes the second recess portion, the protective element.

8. A mixing shaft as set forth in claim 1 characterised in that the mixing blade portion and the tool holder are connected together by way of a positively locking connection.

9. A mixing shaft as set forth in claim 8 characterised in that the mixing blade portion has a through opening arranged in the first recess portion is a pin connected to the tool holder, wherein for fixing the mixing blade portion same can be pushed with its through opening over the pin.

10. A mixing shaft as set forth in claim 5 characterised in that the mixing blade portion and the tool holder are connected together by way of a positively locking connection and the tool holder disk is substantially in the form of a circular ring in a cross-section perpendicularly to the axis of rotation, wherein the positively locking connection is arranged closer to the inner radius of the circular ring shape than to the outer radius.

11. A mixing shaft as set forth in claim 9 characterised in that the mixing blade portion has an opening as part of the positively locking connection and the clamping portion (11) at least partially covers the opening.

12. A mixing shaft as set forth in claim 1 characterised in that in the peripheral direction the clamping part (11) is of a maximum extent greater than the maximum extent of the mixing blade portion.

13. A mixing shaft as set forth in claim 8 characterised in that the smallest spacing (a) between the mixing blade portion and the tool holder in the axial direction is less than the necessary displacement travel (c) of the mixing blade portion in the axial direction to release the mixing blade (3) from the positively locking connection.

14. A mixing shaft as set forth in claim 1 characterised in that the clamping part (11) is screwed to the tool holder.

15. A mixing shaft as set forth in claim 7 wherein the protective element is a protective cap (6).

16. A mixing shaft as set forth in claim 8 characterised in that the mixing blade portion and the tool holder are connected together by way of a pin connection.

17. A mixing shaft as set forth in claim 9 characterised in that the through opening has a circular cross-section.

18. A mixing shaft as set forth in claim 11 wherein the clamping part (11) completely covers the opening.

* * * * *